US009687960B2

(12) United States Patent
Butterfield et al.

(10) Patent No.: US 9,687,960 B2
(45) Date of Patent: Jun. 27, 2017

(54) POLISHING PAD CLEANING SYSTEMS EMPLOYING FLUID OUTLETS ORIENTED TO DIRECT FLUID UNDER SPRAY BODIES AND TOWARDS INLET PORTS, AND RELATED METHODS

(71) Applicant: Applied Materials, Inc., Santa Clara, CA (US)

(72) Inventors: Paul D. Butterfield, San Jose, CA (US); Shou-Sung Chang, Redwood City, CA (US); Bum Jick Kim, Irvine, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 196 days.

(21) Appl. No.: 14/523,482

(22) Filed: Oct. 24, 2014

(65) Prior Publication Data

US 2016/0114459 A1 Apr. 28, 2016

(51) Int. Cl.

| | |
|---|---|
| ***C23F 1/00*** | (2006.01) |
| ***B24B 53/017*** | (2012.01) |
| ***B24B 53/02*** | (2012.01) |
| ***B24B 1/00*** | (2006.01) |

(52) U.S. Cl.

CPC ..... *B24B 53/017* (2013.01); *B24B 1/00* (2013.01); *B24B 53/02* (2013.01)

(58) Field of Classification Search

CPC ..... B24B 1/00; B24B 53/017; B24B 53/02
USPC ..... 216/88, 89; 156/345.12
See application file for complete search history.

(56) References Cited

U.S. PATENT DOCUMENTS

| | | | | |
|---|---|---|---|---|
| 6,824,448 | B1 | 11/2004 | Vines et al. | |
| 7,004,820 | B1 | 2/2006 | Teng et al. | |
| 2002/0090896 | A1* | 7/2002 | Li | B24B 53/017 451/56 |
| 2004/0087257 | A1 | 5/2004 | Hong | |
| 2012/0167924 | A1* | 7/2012 | Chen | B24B 53/017 134/33 |

(Continued)

FOREIGN PATENT DOCUMENTS

| | | | |
|---|---|---|---|
| KR | 1020100034618 | A | 4/2010 |
| KR | 1020110123959 | A | 11/2011 |

OTHER PUBLICATIONS

International Search Report and Written Opinion for International Application No. PCT/US2015/044970 dated Nov. 24, 2015.

*Primary Examiner* — Binh X Tran
(74) *Attorney, Agent, or Firm* — Patterson + Sheridan, LLP

(57) ABSTRACT

Polishing pad cleaning systems employing fluid outlets orientated to direct fluid under spray bodies and towards inlet ports, and related methods are disclosed. A polishing pad in combination with slurry contacts a substrate to planarize a surface of the substrate and remove substrate defects while creating debris. A spray system removes the debris from the polishing pad to prevent substrate damage and improve efficiency. By directing fluid under a spray body to the polishing pad and towards an inlet port, the debris may be entrained in the fluid and directed to an inner plenum of the spray body. The fluid-entrained debris is subsequently removed from the inner plenum through an outlet port. In this manner, the debris removal may reduce substrate defects, improve facility cleanliness, and improve pad efficiency.

20 Claims, 11 Drawing Sheets

(56) References Cited

U.S. PATENT DOCUMENTS

2014/0148822 A1* 5/2014 Abdulla Ibrahim Al Mahza ..... A61B 17/3205 606/131

* cited by examiner

POLISHING PAD CLEANING SYSTEMS EMPLOYING FLUID OUTLETS ORIENTED TO DIRECT FLUID UNDER SPRAY BODIES AND TOWARDS INLET PORTS, AND RELATED METHODS

BACKGROUND

Field

Embodiments of the present disclosure generally relate to creating planar surfaces on substrates and on layers formed on substrates, and specifically to chemical-mechanical polishing (CMP).

Description of the Related Art

In the fabrication of integrated circuits and other electronic devices, multiple layers of conducting, semiconducting, and dielectric materials are deposited on or removed from a surface of a wafer substrate, such as a semiconductor substrate or a glass substrate. As layers of materials are sequentially deposited on and removed from the substrate, the uppermost surface of the substrate may become non-planar and require planarization before further lithographic patterning can be patterned thereon. Planarizing a surface, or "polishing" a surface, is a process where material is removed from substrate surface to form a generally even, planar substrate surface. Planarization is useful in removing undesired surface topography and surface defects, such as rough surfaces, agglomerated materials, crystal lattice damage, scratches, and contaminated layers or materials. Planarization is also useful in forming features on a substrate by removing excess material which has been deposited to fill the features, and to provide an even surface for subsequent lithography-based patterning steps.

Chemical mechanical planarization, or chemical mechanical polishing (CMP), is a common technique for planarizing substrates. CMP utilizes a chemical composition, typically mixed with an abrasive to form a slurry, for selective removal of material from the surface of a substrate. In conventional CMP techniques, a substrate carrier or polishing head is mounted on a carrier assembly to position a substrate secured therein in contact with a polishing pad in a CMP apparatus. The carrier assembly provides a controllable pressure to the substrate urging the substrate against the polishing pad. The polishing pad is moved relative to the substrate by an external driving force. Thus, the CMP apparatus creates polishing or rubbing movement between the surface of the substrate and the polishing pad while dispersing a polishing composition, or slurry, to effect both chemical activity and mechanical activity. The polishing pad has a precise shape to distribute the slurry and contact the substrate. The polishing pad may be cleaned to remove debris which would otherwise collect upon the polishing pad and cause damage to substrates processed therewith and reduce the polishing pad life. Conventional methods of cleaning may in some cases involve directing a de-ionized water (DIW) spray against the polishing pad. The spray often causes slurry and debris to become deposited on the pad and thereby collect in undesirable places resulting in substrate contamination or scratching of later-polished substrates. The spray also can in some cases create a mist, including the debris, which can accumulate in a manufacturing facility to reduce overall cleanliness and scratch later-polished substrates. Reducing the velocity of the spray to better control the debris has a downside of reducing the effectiveness of debris removal from the polishing pad. What is needed are better approaches for cleaning the polishing pad by effectively removing debris while minimizing the potential to contaminate or scratch later-polished substrates.

SUMMARY

Embodiments disclosed herein include polishing pad cleaning systems employing fluid outlets oriented to direct fluid under spray bodies and toward inlet ports, and related methods. A polishing pad in combination with slurry contacts a substrate to planarize the material at the surface thereof, and resultantly create debris. A spray system removes the debris from the polishing pad to prevent damage to later-polished substrates and to improve pad efficiency. By directing fluid under a spray body to the polishing pad and towards an inlet port, the debris may be entrained in the fluid and directed, or pulled, into an inner plenum of the spray body. The fluid-entrained debris is subsequently removed from the inner plenum through an outlet port of the spray body. In this manner, the debris removal may reduce substrate defects, improve facility cleanliness, and extend pad life.

In one embodiment, a spray system for a polishing pad is disclosed. The spray system includes a spray body having a bottom side and a top side. The spray body also includes an inlet port open to the bottom side, an inner plenum, and an exit port. The spray system also includes a first group of fluid outlets having an orientation that directs fluid exiting the first group of fluid outlets under the bottom side of the spray body and towards the inlet port. In this manner, debris may be entrained by the fluid and effectively removed from the polishing pad.

In another embodiment, a chemical mechanical polishing (CMP) system is disclosed. The CMP system has a platen for supporting a polishing pad and a polishing head for retaining a substrate while polishing. An improvement of the CMP system includes a spray body having a bottom side facing the platen and a top side. The spray body includes an inlet port open to the bottom side, an inner plenum, and an exit port. The improvement further includes a first group of fluid outlets having an orientation that directs fluid exiting the first group of fluid outlets under the bottom side of the spray body and towards the inlet port. In this manner, fluid having high kinetic energy may be used to entrain and remove debris from the polishing pad without distributing the entrained debris over the surface of the pad.

In yet another embodiment, a method of polishing a substrate is disclosed. The method includes polishing a substrate on a polishing pad. The method also includes directing fluid from a first group of fluid outlets coupled to a spray body against the polishing pad, under a bottom side of the spray body, and towards an inlet port formed in the spray body. The method further includes removing the fluid directed against the polishing pad from the first group of fluid outlets to the polishing pad through the inlet port and into the spray body. In this manner, substrate quality issues related to debris collecting at the polishing pad can be more readily avoided.

In one embodiment, a spray system for a polishing pad is disclosed. The spray system includes a spray body including at least one inlet port, an inner plenum, and an exit port, wherein each of the at least one inlet ports include an inlet port center axis configured to be disposed orthogonal or substantially orthogonal to a working surface of the polishing pad. The spray system also includes at least one group of fluid outlets supported by the spray body and arranged to direct fluid along respective fluid outlet center axes, wherein the respective fluid outlet center axes of any one group of the at least one group of fluid outlets are angled relative to each other and directed to intersect at a convergence point disposed along, or adjacent to, an associated one of the inlet port center axes. In this manner, fluid having high kinetic energy may be used to entrain and remove debris from the polishing pad without distributing the received debris over the surface of the pad.

In another embodiment, a method is disclosed. The method includes directing fluid from at least one group of fluid outlets along respective fluid outlet center axes. The at least one group of fluid outlets are supported by a spray body, wherein the respective fluid outlet center axes of any one group of the at least one group of fluid outlets are angled relative to each other and directed to intersect at a convergence point disposed along or adjacent to at least one inlet port center axis of at least one inlet port of the spray body. The method also includes receiving the fluid directed from the at least one group of fluid outlets at a working surface of a polishing pad. The method also includes guiding, with the at least one inlet port of the spray body, the fluid received at the working surface of the polishing pad to an inner plenum of the spray body, wherein each of the at least one inlet port includes an inlet port center axis disposed orthogonal or substantially orthogonal to the working surface of the polishing pad. The method also includes flowing the fluid out from the inner plenum of the spray body through an exit port. In this manner, the debris may be efficiently removed from the polishing pad without contaminating the manufacturing area.

In another embodiment, a chemical-mechanical polishing (CMP) system is disclosed. The CMP system includes a polishing pad secured to a rotatable platen. The CMP system also includes a polishing head arranged to position a surface of a substrate against the polishing pad. The CMP system also includes a spray body including at least one inlet port, an inner plenum, and an exit port, wherein each of the at least one inlet port includes an inlet port center axis configured to be disposed orthogonal or substantially orthogonal to a working surface of the polishing pad. The CMP system also includes at least one group of fluid outlets supported by the spray body and arranged to direct fluid along respective fluid outlet center axes. The respective fluid outlet center axes of any one group of the at least one group of fluid outlets are angled relative to each other and directed to intersect at a convergence point disposed along or adjacent to an associated one of the inlet port center axes. In this manner, substrate quality issues related to debris collecting at the polishing pad can be more readily avoided.

Additional features and advantages will be set forth in the detailed description which follows, and in part will be readily apparent to those skilled in the art from that description or recognized by practicing the embodiments as described herein, including the detailed description that follows, the claims, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIGS. 6A and 6B-1 are a front sectional view and a partial bottom sectional view, respectively, of yet another embodiment of a spray system including standoffs and the spiral-shaped inlet port;

FIGS. 6B-2 through 6B-3 are partial bottom sectional views, respectively, of further embodiments of a spray system with alternative examples of standoffs;

To facilitate understanding, identical reference numerals have been used, where possible, to designate identical elements that are common to the figures. It is contemplated that elements and features of one embodiment may be beneficially incorporated in other embodiments without further recitation

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Whenever possible, like reference numbers will be used to refer to like components or parts.

Embodiments disclosed herein include polishing pad cleaning systems employing a spray body with fluid outlets oriented to direct fluid under spray bodies and toward inlet ports, and related methods. A polishing pad in combination with slurry contacts a substrate to planarize the material at the surface thereof, and resultantly create debris. A spray system removes the debris from the polishing pad to prevent damage to later-polished substrates and to improve pad efficiency. By directing fluid under a spray body to the polishing pad and towards an inlet port of the spray body, the debris may be entrained in the fluid and directed, or pulled, into an inner plenum of the spray body. The fluid-entrained debris is subsequently removed from the inner plenum through an outlet port of the spray body. In this manner, the debris removal may reduce substrate defects, improve facility cleanliness, and extend pad life.

Figure 1:
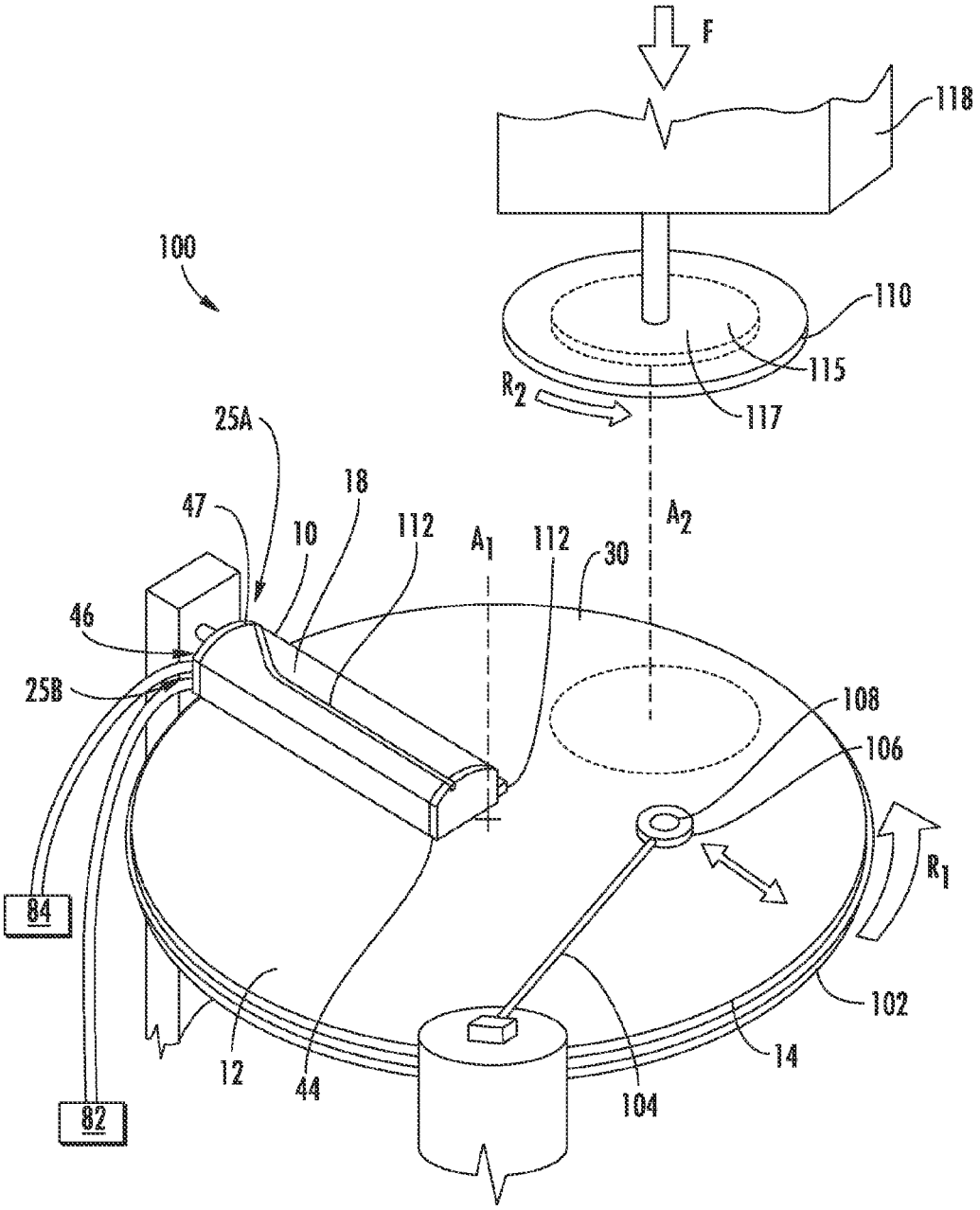
FIGS. 1 and 2 are a top perspective view and a schematic top plan view of an exemplary chemical-mechanical polishing (CMP) system employing an exemplary spray system to remove debris from a polishing pad of the CMP system.
Figure 2:
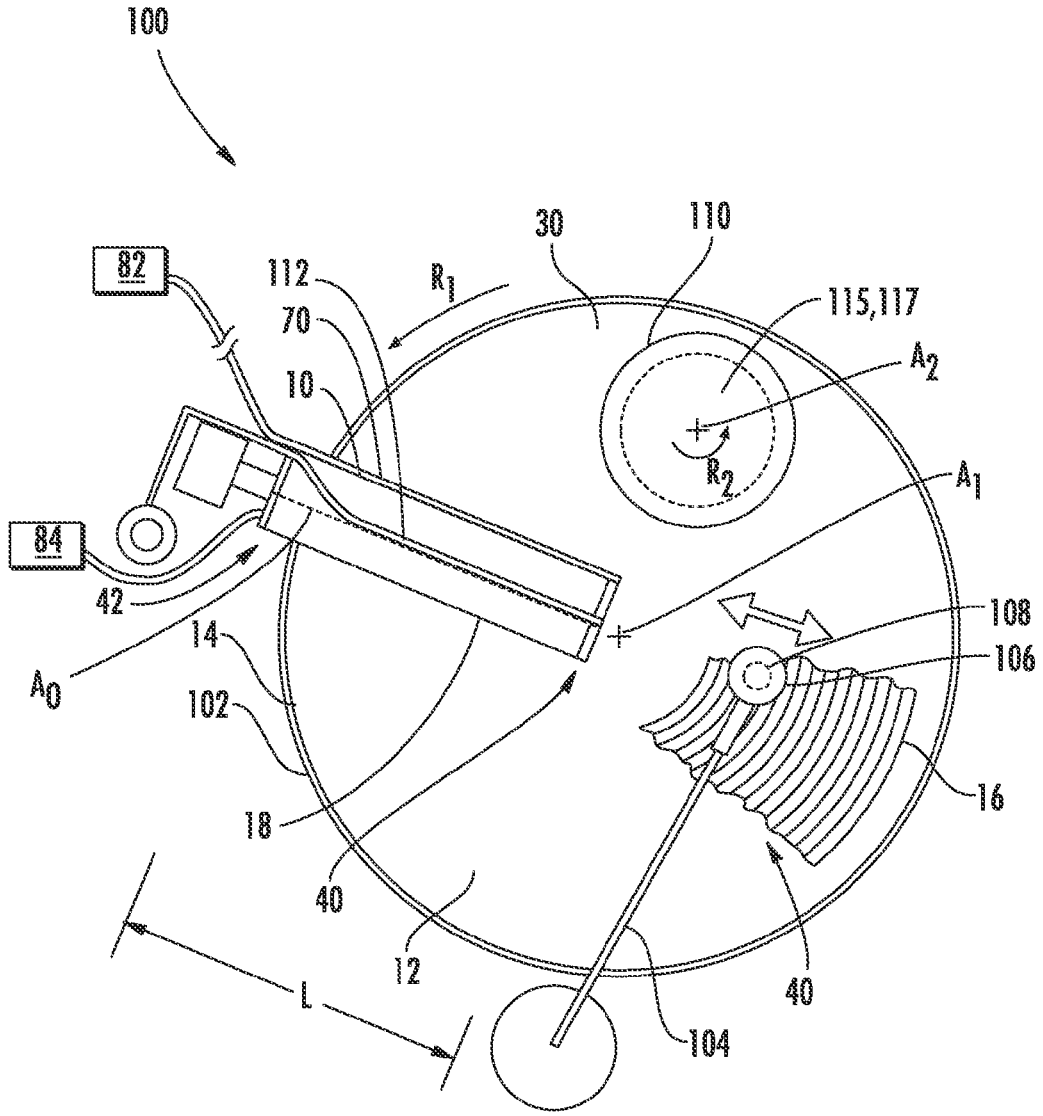

FIGS. 1 and 2 are a top perspective view and a schematic top plan view of an exemplary chemical-mechanical polishing (CMP) system 100 which includes a polishing pad 14, a conditioning head 106, a slurry dispenser 112, and a spray system 10. The CMP system 100 is used to planarize a process surface 117 of substrate 115, so that undesirable topography and surface defects are removed therefrom. As part of this process debris 30 is generated and collected on the polishing pad 14. As discussed later in relation to FIG. 3A, the spray system 10 employs a spray body 18 and a group of fluid outlets 22A to direct fluid 23 under the spray body to the polishing pad 14 and towards an inlet port of the spray body. In some embodiments, a second group fluid outlets 22B may also be used. In this manner, the debris 30 may be entrained in the fluid 23 and directed, or pulled, into an inner plenum of the spray body for removal from the CMP system 100. Before discussing details of the spray system 10, the operation and other components of the CMP system 100 are now introduced to provide context as the polishing pad 14, the conditioning head 106, and the slurry dispenser 112 are now discussed in terms of their operation as part of the CMP system 100.

In this regard, the polishing pad 14 and polishing head 110 of the CMP system 100 may be used to planarize the process surface 117 of the substrate 115 by use of physical contact of the process surface 117 of the substrate 115 against the polishing pad 14 and by use of relative motion. The planarization removes undesired surface topography and surface defects in preparation for subsequent processes where layers of materials are sequentially deposited on and removed from the process surface 117 of the substrate 115. The substrate 115 may be, for example, a semiconductor wafer. During planarization, the substrate 115 may be mounted in the polishing head 110 and the process surface 117 of the substrate 115 is positioned by a carrier assembly 118 of the CMP system 100 to contact the polishing pad 14 of the CMP system 100. The carrier assembly 118 provides a controlled force F to the substrate 115 mounted in the polishing head 110 to urge the process surface 117 of the substrate 115 against the working surface 12 of the polishing pad 14. In this manner, contact is created between the substrate 115 and the polishing pad 14.

With continued reference to FIGS. 1 and 2, removal of the undesirable topography and surface defects is also accomplished by relative rotational movement between the polishing pad 14 and the substrate 115 in the presence of slurry therebetween. A platen 102 of the CMP system 100 supports the polishing pad 14 and provides rotational movement R1 to the polishing pad 14 about an axis of rotation A1. The platen 102 may be rotated by a motor in a base (not shown) of the CMP system 100. The carrier assembly 118 may also provide rotational movement R2 about an axis of rotation A2 to the substrate 115 mounted within the polishing head 110. Within the environment of this relative motion is the slurry. The working surface 12 of the polishing pad 14 may be generally planar, but may also include grooves 16 which may improve the performance of the polishing pad 14 by distributing the slurry. The slurry may include a chemical composition, typically mixed with an abrasive, for selective removal of material from the process surface 117 of the substrate 115. The CMP system 100 may include at least one slurry dispenser 112 to dispose slurry at one or more radii of the polishing pad 14 before, during or after the relative motion. FIGS. 1 and 2 depict the slurry dispenser 112 supported by the spray system 10, but in other embodiments (not shown) the slurry dispenser 112 can be incorporated as part of another component. The slurry, characteristics of the polishing pad 14, the force F, and the rotational movements R1, R2 create frictional forces and abrasive forces at the process surface 117 of the substrate 115. The frictional forces and the abrasive forces remove generate debris 30 as the undesired surface topography and surface defects are removed from the process surface 117 of the substrate 115. In this manner, the debris 30 may collect on the working surface 12 of the polishing pad 14.

The CMP system 100 includes other components to ensure consistent polishing. With continued reference to FIGS. 1 and 2, during planarization the frictional forces and abrasive forces can also cause wear to the polishing pad 14 which may necessitate periodic roughening (conditioning) to maintain the effectiveness of the polishing pad 14 and ensures consistent polishing rates. In this regard, the CMP system 100 further comprises a pivot arm 104 with the conditioning head 106 mounted to one end of the pivot arm 104, and a pad conditioner 108. The pad conditioner 108 may be a pad embedded with diamond crystals, mounted to the underside of the conditioning head 106. The pivot arm 104 is operatively coupled to platen 102, and maintains the pad conditioner 108 against the polishing pad 14 as the pivot arm 104 sweeps back and forth across the radius of polishing pad 14 in an arcing motion to condition the polishing pad 14. In this manner, the polishing pad 14 may be conditioned to provide consistent polishing rates.

In addition to conditioning, the polishing pad 14 is also maintained within the CMP system 100 by cleaning using the spray system 10. Cleaning of the polishing pad 14 must be performed frequently to clean the debris 30 (polishing residue and compacted slurry) from the polishing pad 14. In one embodiment, cleaning may comprise removing the substrate 115 mounted within the polishing head 110 from contact with the polishing pad 14 and turning off the supply of slurry from the slurry dispenser 112, so that the fluid 23 (discussed later in reference to FIG. 3A) directed by the spray system 10 may remove the debris 30 from the polishing pad 14. In this manner, the polishing pad 14 may be cleaned of the debris 30.

Figure 3A:
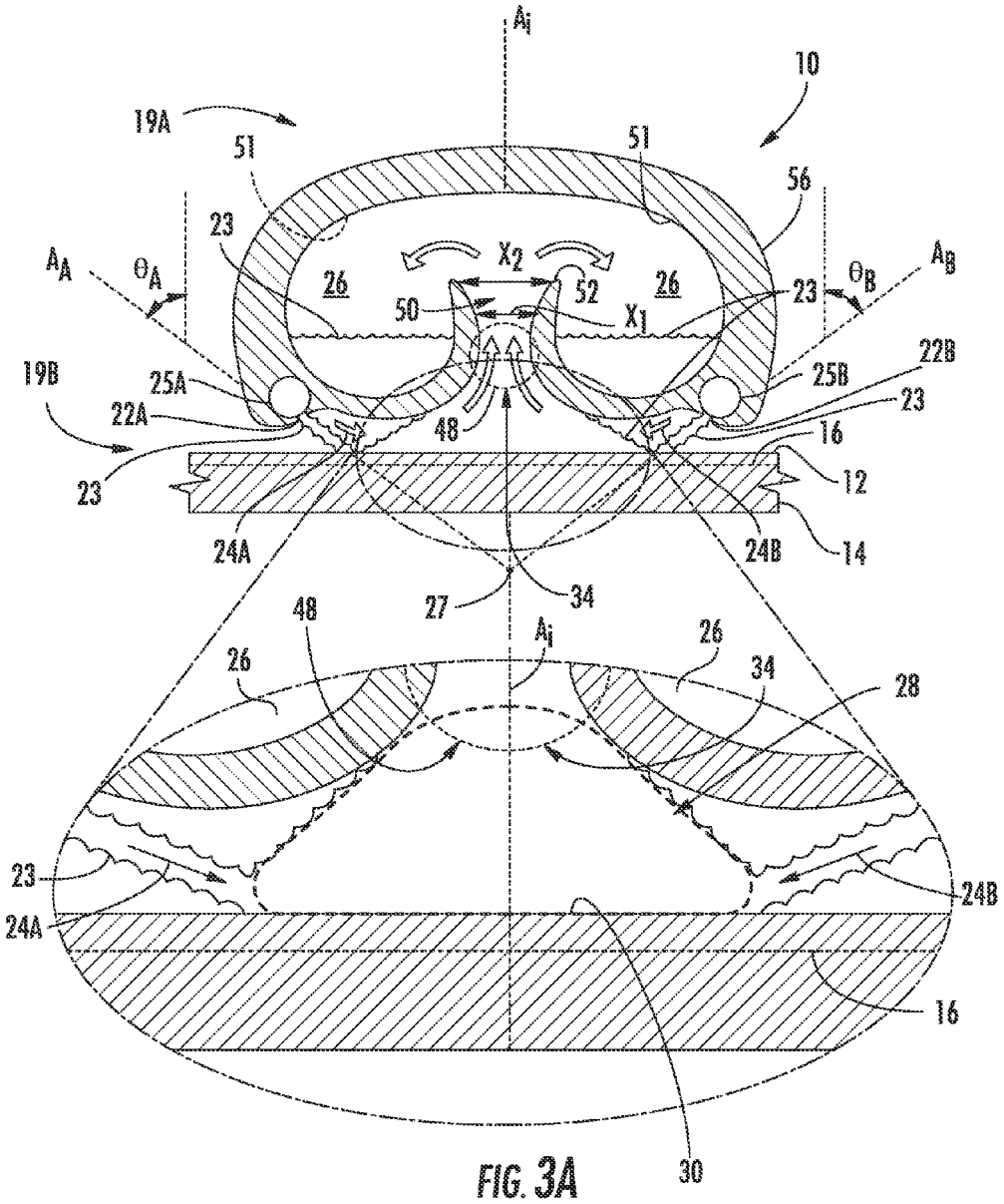
FIG. 3A is a front sectional view of the spray system of FIG. 1 proximate to the polishing pad to be cleaned of debris, the spray system is depicted to include the spray body and a group of fluid outlets supported by the spray body and arranged to direct fluid along respective fluid outlet center axes, wherein the fluid outlet center axes are angled relative to each other and directed to intersect at, or adjacent to, an inlet port center axis of an associated inlet port of the spray body.
Figure 3B:
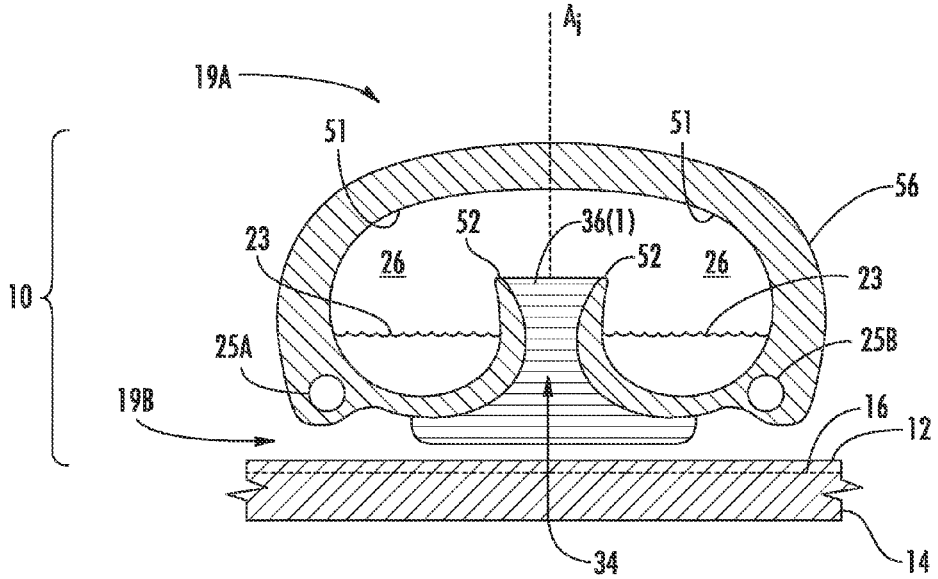
FIG. 3B is a front sectional view of the spray system of FIG. 3A depicting at least one partition of the at least one inlet port of the spray body.
Figure 3C:
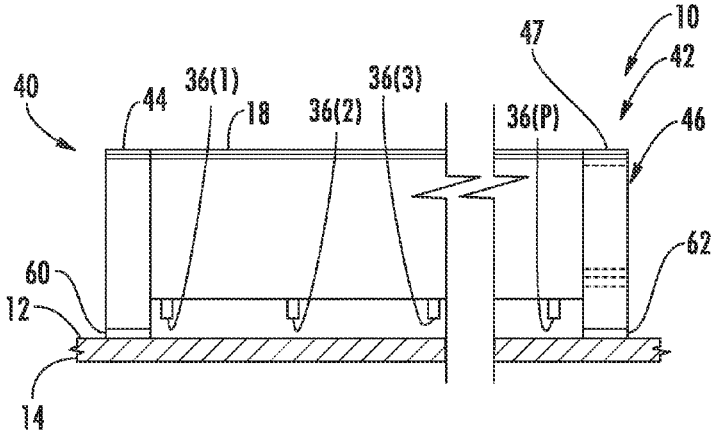
FIG. 3C is a right side view of a portion of the spray body of FIG. 3A depicting a first fluid outlet of the group of fluid outlets and conduits of an inlet port of the spray body of FIG. 3A.
Figure 3D:
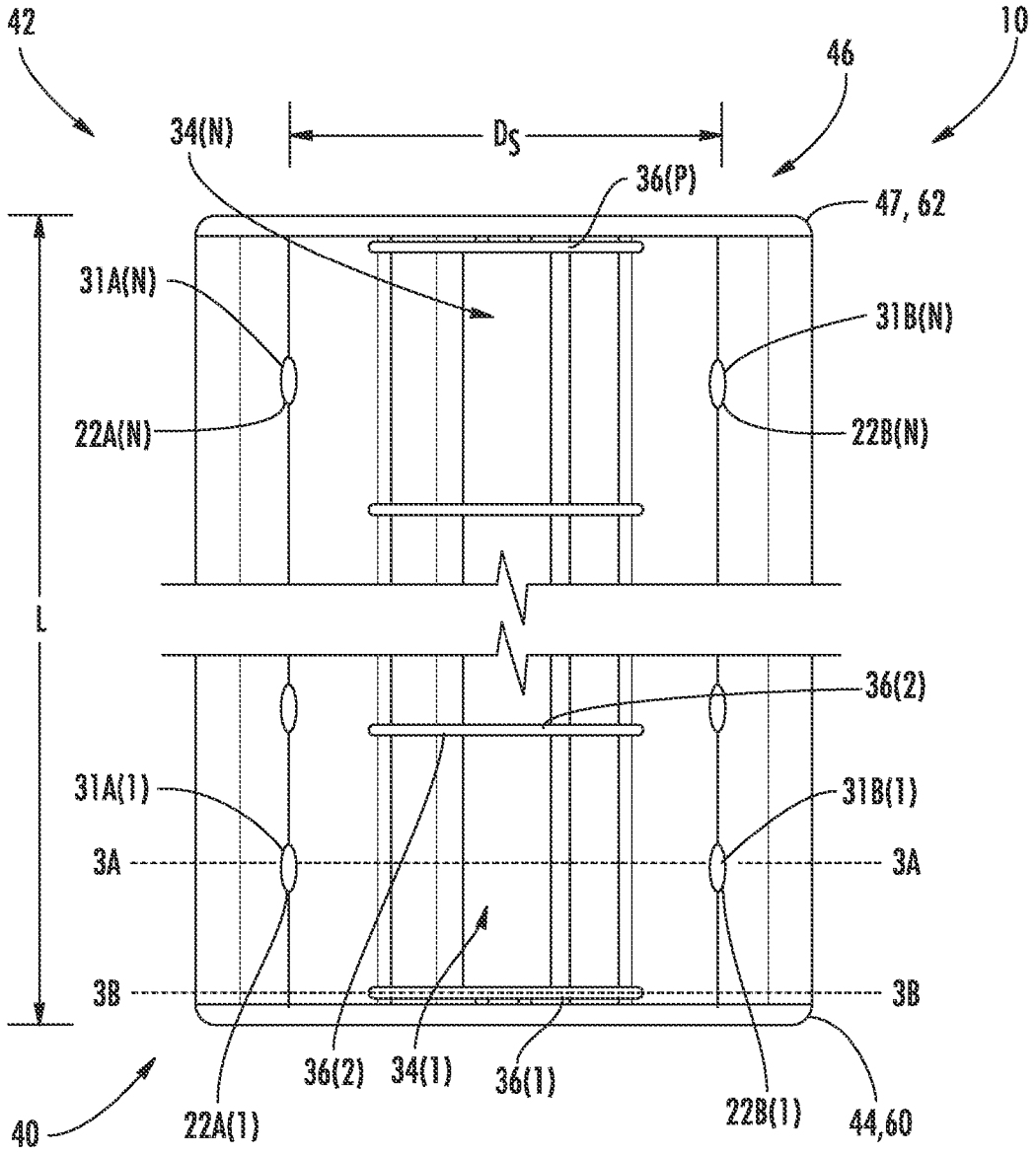
FIG. 3D is a bottom view of the portion of the spray system in FIG. 3C depicting exemplary relative positions of the group of fluid outlets.

Now that the operation of the CMP system 100 has been introduced, an embodiment of a spray system 10 is now discussed in detail. In this regard, FIGS. 3A and 3B are front sectional views and FIG. 3C is a right side view of the spray system 10 of FIG. 1. FIG. 3D is a bottom view of a portion of the spray system 10. The spray system 10 includes the spray body 18, the plug wall 44, the interconnection plate 47, fluid conduits 25A, 25B, the first group of fluid outlets 22A(1)-22A(N), the second group of fluid outlets 22B(1)-22B(N), and the partitions 36(1)-36(P). The spray body 18 includes a top side 19A, a bottom side 19B, and the inlet port 34. The spray body 18 may include a convex exterior top surface to avoid collection of the fluid 23 during operation. The first group of fluid outlets 22A(1)-22A(N) and the second group of fluid outlets 22B(1)-22B(N) are oriented to direct fluid 23 under the bottom side 19B of the spray body 18 and towards the inlet port 34. Further, in this embodiment, the fluid outlets 22A(1)-22A(N), 22B(1)-22B(N) are arranged to direct the fluid 23 along respective fluid outlet center axes AA, AB, wherein the fluid outlet center axes AA, AB are angled relative to each other and directed to intersect at, or adjacent to, an inlet port center axis Ai of an inlet port 34(1)-34(N) of the spray body 18. Each fluid outlet of the groups of fluid outlets 22A(1)-22A(N), 22B(1)-22B(N) may be similar in operation and together remove the debris 30 from the polishing pad 14.

As a brief introduction, the spray body 18 may extend a length L (FIG. 2) from the first side 42 to the second side 40. The length L, may in some cases, be at least as long eighty (80) percent of a radius of the polishing pad 14 and in other examples, commensurate with a size of the polishing pad 14. In this regard, the fluid conduits 25A, 25B supplying fluid 23 to the fluid outlets 22A(1)-22A(N), 22B(1)-22B(N) may extend along a longitudinal axis A0 (FIG. 2) from at least from the first side 42 to the second side 40 of the spray body 18. A trajectory of the longitudinal axis A0 from the first side 42 to the second side 40 of the spray body 18 may be linear, curved, curvilinear, or another shape as desired. The length of the fluid conduits 25A, 25B allows the fluid outlets 22A(1)-22A(N), 22B(1)-22B(N) to be arranged along the spray body 18 and for distributed placement along the radius of the polishing pad 14 to deliver the fluid 23 to the polishing pad 14 and generate high energy zones 28(1)-28(N) (discussed later) to disengage the debris 30 from the polishing pad 14. The spray system 10 may also include the partitions 36(1)-36(P) disposed in the inlet port 34 and separating the inlet port 34 into the inlet ports 34(1)-34(N) associated respectively with the first group of fluid outlets 22A(1)-22A(N) and respectively with the group of fluid outlets 22B(1)-22B(N) to facilitate the fluid 23 to enter into the inlet ports 34(1)-34(N) of the spray body 18. When the spray body 18 is disposed above the polishing pad 14 to enable operation, the partitions 36(1)-36(N) may extend below the bottom 19B of the spray body 18 towards the polishing pad 14. In this manner the partitions 36(1)-36(P) may be disposed to more efficiently receive at the inlet ports 34(1)-34(N), the fluid 23 with the debris 30 entrained.

With a continued discussion of the inlet ports 34(1)-34(N), each of the inlet ports 34(1)-34(N) may extend to an inner lip 52 disposed within an inner plenum 26 of the spray body 18. The fluid 23 from the high energy zones 28(1)-28(N) may travel through the inlet ports 34(1)-34(N) to the inner plenum 26. An exit port 46 of the spray body 18 may cooperatively operate with the inner lip 52 to prevent backflow of the fluid 23 (see FIG. 3A), and the debris 30 entrained within the fluid 23, from returning to the polishing pad 14. In this manner, the polishing pad 14 (FIG. 3A) may be kept free of the debris 30 which may extend the life of the polishing pad 14.

With continued reference to FIGS. 3A through 3D, specific details of the components of the spray system 10 including the spray body 18, the plug wall 44, the interconnection plate 47, the fluid conduits 25A, 25B, the groups of fluid outlets 22A(1)-22A(N), 22B(1)-22B(N), and the partitions 36(1)-36(P) are now discussed. It is noted that the plug wall 44, the interconnection plate 47, and the partitions 36(1)-36(P) may be formed integral to the spray body 18, but alternatively may be formed separately as described and depicted herein. These components will now be discussed sequentially in detail.

In this regard, the spray body 18 may serve as the structural foundation for the spray system 10. The spray body 18 may extend for the length L (FIG. 2) from the first side 42 to the second side 40 and comprise a strong resilient material, for example, metal, aluminum, and/or plastic. The length L may be in a range, for example, from one-hundred (100) millimeters to five-hundred (500) millimeters. The inner surface 51 of the spray body 18 may form at least part of the inner plenum 26. The inlet ports 34(1)-34(N) which provide passage for the fluid 23 into the inner plenum 26 may be formed integral with the spray body 18. In this manner, the spray body 18 enables the fluid outlet center axes AA, AB, respectively, of the groups 20(1)-20(N) of the fluid outlets 22A, 22B to be precisely positioned relative to the inlet port central axis Ai, so that the debris 30 entrained within the fluid 23 may flow to the inner plenum 26.

The plug wall 44 and the interconnection plate 47 are both used to guide the fluid 23 with the entrained debris 30 out from the inner plenum 26. The plug wall 44 and the interconnection plate 47 may comprise a strong resilient material, for example, metal, aluminum, and/or plastic. The plug wall 44 and the interconnection plate 47 may be secured to the second side 40 and the first side 42 of the spray body 18, respectively, with a thermal bond, cohesive bond, adhesive bond, or by a mechanical attachment. In some embodiments not shown, the plug wall 44 and the interconnection plate 47 may be integrally formed with the spray body 18, for example, with plastic injection molding. The plug wall 44 may block the movement of the fluid 23 at the second side 40 of the spray body 18 and thereby help guide the fluid 23 to the first side 42 of the spray body 18 where the exit port 46 forms a passageway through the interconnection plate 47 for the fluid 23 to exit the inner plenum 26. In this manner, the debris 30 may be removed from the inner plenum 26.

Relative to the plug wall 44 and the interconnection plate 47, it is noted that a first contact member 60 and a second contact member 62 may be used to form an abutment against the working surface 12 of the polishing pad 14 (see FIG. 3A) during cleaning. In some embodiments, the first contact member 60 may be attached to the plug wall 44 and the second contact member 62 may be attached to the interconnection plate 47. In other cases the first and second contact members 60, 62 can be attached at other locations along the spray body 18. The first contact member 60 and the second contact member 62 may comprise an abradable material, for example, plastic to prevent damage to the polishing pad 14 during the abutment. The first contact member 60 and the second contact member 62 may have height dimensions to dispose the spray body 18 at a predetermined relative position to the polishing pad 14 during cleaning. In this manner, the inlet center axes Ai of the inlet ports 34(1)-34(N) may be positioned orthogonal or substantially orthogonal to the polishing pad 14 to facilitate the fluid 23 to efficiently flow into the inlet ports 34(1)-34(N).

With continued reference to FIGS. 3A through 3D, the fluid conduits 25A, 25B may supply the fluid 23 to the groups 20(1)-20(N) of the fluid outlets 22A, 22B and maintain a constant position of the fluid outlets 22A, 22B relative to the spray body 18. The fluid conduits 25A, 25B may be of a cylindrical shape to provide a smooth inner passageway for the fluid 23 flow and the inner surface of the fluid conduits 25A, 25B may comprise a strong resilient material, for example, metal, aluminum, or plastic to be resistant to leakage of the fluid 23. It is noted that the fluid conduits 25A, 25B may be in communication with one or more fluid pump 82 (FIG. 1) to provide the fluid 23 under pressure to the fluid conduits 25A, 25B. In this manner, the fluid 23 may be supplied to the spray system 10.

The groups of the fluid outlets 22A(1)-22A(N), 22B(1)-22B(N) respectively direct the fluid 23 along the fluid outlet axes AA, AB to the convergence points 27(1)-27(N) on, or adjacent to, the respective associated inlet axes Ai. The groups of the fluid outlets 22A(1)-22A(N), 22B(1)-22B(N), for example, may have openings 31A, 31B (FIG. 3D) which are a circular or rectangular to direct the fluid 23. In some embodiments, the groups of fluid outlets 22A(1)-22A(N), 22B(1)-22B(N) may comprise shaped apertures through portions of the spray body 18. In this manner, the fluid 23 may be directed to the polishing pad 14 at the angular positions theta_A, theta_B ($\theta_A$, $\theta_B$) relative to the inlet port central axes Ai (see FIG. 3A) to ensure flow of the fluid 23 to associated ones of the inlet ports 34(1)-34(N). In other embodiments, the fluid outlets 22A, 22B can comprise comprises at least one of a slit, a hole, a replaceable nozzle fitting, and a deflector. The deflector may be a surface that generates a fan-shaped spray (and be part or separate from the fluid outlet).

With continued reference to FIGS. 3A through 3D, the spray system 10 may include the partitions 36(1)-36(P) to facilitate movement of the fluid 23 to the inlet ports 34(1)-34(N) by blocking movement of the fluid 23 parallel to the working surface 12 of the polishing pad 14 (FIG. 3A). The partitions 36(1)-36(P) may be secured to the spray body 18 adjacent to (or between) the inlet ports 34(1)-34(N) with one or more thermal bonds, cohesive bonds, adhesive bonds, or by mechanical attachments. In some embodiments, the partitions 36(1)-36(P) may be formed integrally with the spray body 18. In this manner, the partitions 36(1)-36(P) may be used to restrict the movement of the fluid 23 parallel to the working surface 12 of the polishing pad 14 and guide the fluid 23 to the inlet ports 34(1)-34(N) of the spray body 18 through which the debris 30 entrained in the fluid 23 may be removed from the polishing pad 14.

With reference back to FIG. 3A, features of the flow of the fluid 23 through the spray system 10 and dimensional relationships between the groups of fluid outlets 22A(1)-22A(N), 22B(1)-22B(N), polishing pad 14, and inlet port 34 are now discussed. FIG. 3A as discussed before is a front sectional view of the spray system 10 proximate to the working surface 12 of the polishing pad 14. The working surface 12 may be utilized to improve the planarality and remove selected material from the substrate 115 (FIG. 1) while during operation producing debris. The debris 30 may collect on the working surface 12, and unless the debris 30 is removed, the performance of the polishing pad 14 may be impaired and/or subsequently later-polished substrates may be damaged or contaminated thereby. The working surface 12 may be generally planar, but may also include the grooves 16 which may improve the performance of the polishing pad 14 by distributing the slurry at the expense of collecting the debris and making debris removal more difficult. The spray system 10 removes the debris 30 and thereby may be used to restore and/or maintain performance of the polishing pad 14.

With continued reference to FIG. 3A, the spray system 10 includes the spray body 18 and groups of fluid outlets 22A(1)-22A(N), 22B(1)-22B(N) supported by or integrated with the spray body 18, and supplied with the fluid 23 by fluid conduits 25A, 25B. The groups of fluid outlets 22A(1)-22A(N), 22B(1)-22B(N) direct the fluid 23 under the spray body 18 to the polishing pad 14 and towards the inlet ports 34(1)-34(N). As the fluid 23 travels to the inlet ports 34(1)-34(N), the fluid 23 entrains the debris 30 from the polishing pad 14. The inlet ports 34(1)-34(N) define a passageway to the inner plenum 26 of the spray body 18 which can guide the fluid 23, and the debris 30 entrained within the fluid 23, to the exit port 46 and away from the polishing pad 14. In this manner, the working surface 12 of the polishing pad 14 may be efficiently cleaned of the debris 30.

The spray system 10 includes other features to enable efficient operation. In particular, the fluid outlets 22A, 22B are arranged to direct the fluid 23 along fluid outlet center axes AA, AB, respectively. The fluid outlet center axes AA, AB are angled relative to each other and intersect at the convergence point 27. The fluid 23, the direction of which is shown at arrows 24A, 24B exits the fluid outlets 22A, 22B in the direction of the convergence point 27 and interacts to form a turbulent, high energy zone 28 at the working surface 12. Momentum of the fluid 23 provides power to the high energy zone 28 where the fluid 23 interacts with the debris 30 collected earlier at the working surface 12. The fluid 23 dislodges the debris 30 from the working surface 12 at the high energy zone 28 and the debris 30 becomes entrained in the fluid 23 as the fluid 23 moves within the high energy zone 28 and away from the working surface 12 as indicated by arrow 24C. The fluid 23 may comprise, for example, de-ionized water and/or other substances which may chemically interact with the debris 30 to facilitate removal of the debris 30 from the working surface 12. In this manner, the debris 30 may be removed from the working surface 12.

The spray system 10 also facilitates transport of the debris 30 from the polishing pad 14 and the high energy zone 28. The impact momentum of opposed streams of the fluid 23 entering the high energy zone 28 acts to prevent the fluid 23 already in the high energy zone 28 from departing the high energy zone 28 in directions parallel to the working surface 12. Pressure resulting from the fluid 23 continuously flowing into the high energy zone 28 accumulates in the high energy zone 28 and the fluid 23 and the pressure (and momentum from the fluid 23 reflected off the working surface 12) pushes the fluid 23 away from the working surface 12 and expands the high energy zone 28 to the at least one inlet port 34 of the spray body 18. The inlet port 34 may have an inlet port central axis Ai which is disposed orthogonal or substantially orthogonal to a working surface 12 of the polishing pad 14. The term "substantially orthogonal" as used herein means within ten (10) degrees of orthogonal. The angular position of the inlet port central axis Ai relative to the polishing pad 14 facilitates entry of the fluid 23 into the spray body 18 by not favoring momentum contributions to the high energy zone 28 from any single one of the fluid outlets 22A, 22B which direct the fluid 23 into the high energy zone 28. In this regard, the fluid outlet center axes AA, AB, respectively, have angular positions theta_A, theta_B ($\theta_A$, $\theta_B$) relative to the inlet port central axis Ai and these angular positions theta_A, theta_B may be of the same angular value.

With continuing reference to FIG. 3A, the convergence point 27 is located along, or adjacent to, the inlet port central axis Ai to position the high energy zone 28 at the entrance of the inlet port 34 of the spray body 18 and to better enable the high energy zone 28 to expand into the inlet port 34. Expressed differently, by locating the convergence point 27 at the inlet port central axis Ai, the momentum of the fluid 23 is focused from the fluid outlets 22A, 22B at the inlet port central axis Ai. In this manner, the high energy zone 28 may expand using the momentum energy of the fluid along the inlet port central axis Ai and into the inlet port 34.

The inlet port 34 of the spray system 10 may include additional features to further facilitate the movement of the fluid 23 through the inlet port 34. FIG. 3B is a front sectional view of the spray system 10 of FIG. 3A depicting at least one partition 36(1) of the at least one inlet port 34 of the spray body 18. The partition 36(1) facilitates movement of the fluid 23 to the inlet port 34 by blocking movement of the fluid 23 parallel to the working surface 12 of the polishing pad 14. Further to this point, FIGS. 3C and 3D are a right side view and a bottom view of the spray body 18 depicting the fluid outlet 22B of the group 20 of fluid outlets 22A, 22B and the partitions 36(1), 36(2) of the inlet port 34 of the spray body 18. In this case, the fluid 23 is prevented in multiple directions from departing the high energy zone 28 parallel to the working surface 12. In this manner, the fluid 23 in the high energy zone 28 has a higher probability of being directed, or pulled, with the debris 30 entrained therein, through the inlet port 34. Once the fluid 23 moves to through the inlet port 34(1) and into the inner plenum 26. The inner plenum 26 may extend from a first side 42 of the spray body 18 to a second side 40 opposite the first side 42. In one embodiment shown in FIG. 3C, the spray body 18 may include a plug wall 44 at the second side 40 and an exit port 46 through an interconnection plate 47 at the first side 42. The fluid 23 and the debris 30 entrained therein may depart from the inner plenum 26 through the exit port 46 of the interconnection plate 47. In this manner, the debris 30 may be transported away from the polishing pad 14 to restore performance of the polishing pad 14.

Referring back to FIG. 3A, other features may also further facilitate the movement of the fluid 23 and the debris 30 entrained therein from the high energy zone 28 and through the inlet port 34. The inlet port 34 may include a throat 48 to convert built up pressure of the fluid 23 in the high energy zone 28 into velocity which directs, or pulls, the fluid 23 into a diverging passageway 50. Collectively, the throat 48, inner plenum 26, and the diverging passageway 50 may be formed integrally as part of the spray body 18. The diverging passageway 50 extends to an inner lip 52 disposed within the inner plenum 26. The diverging passageway 50 may be formed by portions of the spray body 18 which may be a diverging shape shape to reduce a speed of the fluid 23 as the fluid 23 reaches the lip 52. The diverging passageway 50 is depicted in FIG. 3A with widths X1 and X2, wherein the downstream width X2 is larger than X1 to provide the diverging shape. The reduced speed may minimize the generation of mist which may carry the debris 30 entrained within the fluid 23 throughout the manufacturing facility and may scratch later-polished substrates and cause other quality issues. The diverging passageway 50 facilitates the conversion of the velocity of the fluid 23 from the throat 48 into gravitational potential energy to lift the fluid 23 up and over the inner lip 52. The resulting lower velocity may reduce the probability that mist, including entrained debris 30, may be formed which can impact the general cleanliness of the manufacturing facility and scratch later-polished substrates. In this regard, widths X1, X2 may be selected to provide a gradual conversion into gravitational potential energy. It is also noted that the partitions 36(1), 36(2) may also extend up from the throat 48 to form part of the inner lip 52.

Moreover, once the fluid 23 achieves a threshold amount of gravitational potential energy, then the fluid 23 travels over the inner lip 52 and into the inner plenum 26. The inner lip 52 works in conjunction with the exit port 46 of the spray body 18 to prevent the fluid 23 from backflowing over the inner lip 52 and returning to the working surface 12 of the polishing pad 14 through the inlet port 34. Consistent with preventing backflow, the exit port 46 of the spray body 18 removes the fluid 23 and the debris 30 contained therein from the inner plenum 26 to keep a fluid level in the inner plenum 26 at an elevation below that of the inner lip 52. In this manner, the fluid 23, with the debris 30 entrained, may be prevented from returning to the working surface 12 as backflow, which if allowed, would decrease performance of the polishing pad 14.

FIG. 3D is a bottom view of the portion of the spray system 10 in FIG. 3C depicting exemplary relative positions of the fluid outlets 22A, 22B. The openings 31A, 31B of the fluid outlets 22A, 22B may have a separation distance Ds that is dependent on several factors including: a distance between the spray body 18 and the polishing pad 14, the velocity of the fluid 23 departing the fluid outlets 22A, 22B, and the angular positions theta_A, theta_B ($\theta_A$, $\theta_B$) relative to the inlet port central axis Ai. In this manner, the fluid 23 may remove the debris 30 from the working surface 12 of the polishing pad 14.

The relative position of the spray body 18 of the spray system 10 to the polishing pad 14 enables the debris 30 entrained within the fluid 23 to flow through the inlet ports 34(1)-34(N). Specifically, in the case of the spray system 10, the spray body 18 may be positioned so that the inlet central axes Ai of the inlet ports 34(1)-34(N) may be orthogonal or substantially orthogonal to the working surface 12 of the polishing pad 14. In order to precisely position the spray body 18 relative to the polishing pad 14, the spray system 10 may include the spacers or contact members 60, 62 (FIG. 3C) to position the spray body 18 relative to the polishing pad 14 by creating an abutment with the polishing pad 14 and thereby defining a bearing surface configured to support the spray body 18 on a polishing pad 14.

With reference back to FIG. 1, the fluid conduits 25A, 25B may be in communication with at least one fluid pump 82 and the exit port 46 may be in communication with a fluid waste system 84. In this manner, the spray system 10 may be positioned so that the fluid 23 is supplied to the spray system 10 and the debris 30 entrained in the fluid 23 may be removed from the polishing pad 14.

Figure 4A:
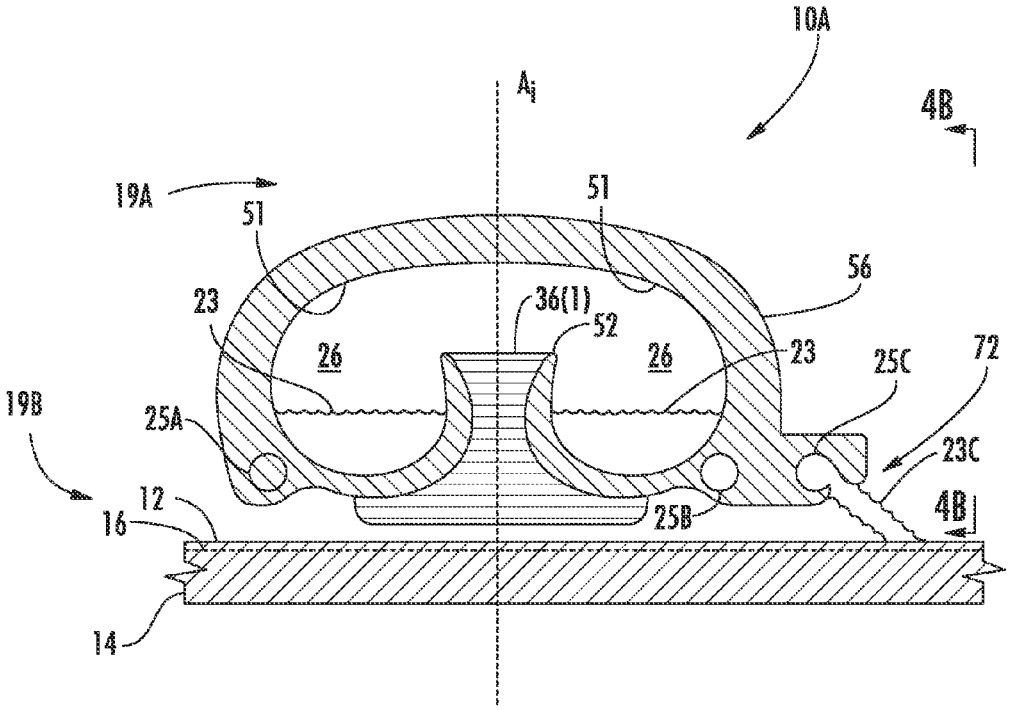
FIGS. 4A and 4B are a front sectional view and a right view, respectively, of another embodiment of a spray system including an integrated rinse subsystem.
Figure 4B:
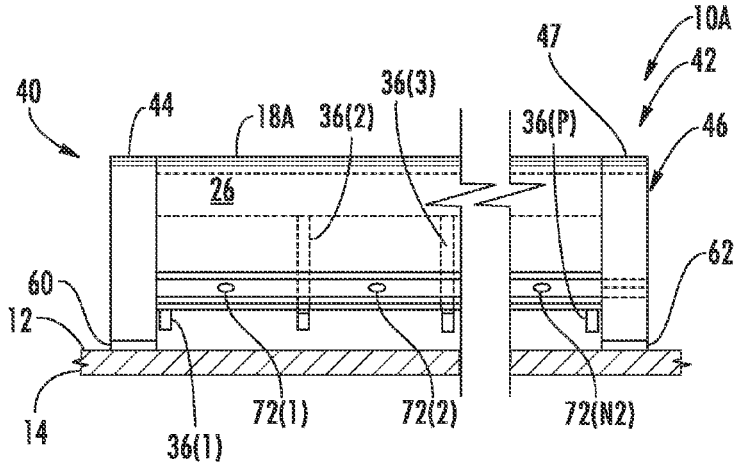

FIGS. 4A and 4B are a front sectional view and a right view, respectively, of another embodiment of a spray system 10A including an integrated rinse subsystem 70. The rinse subsystem 70 may be used to provide additional fluid 23C to the polishing pad 14 to ensure the polishing pad 14 does not dry out. The spray system 10A may be similar to the spray system 10, and thus only the differences will be discussed for conciseness and clarity. The spray body 18A may be similar to the spray system 18 except for the coupling of the rinse subsystem 70. The rinse subsystem 70 may be coupled to a single side of the spray body 18A, for example, either the upstream or downstream side of the spray body 18A relative to the rotation direction of the polishing pad 14. Alternatively, two rinse subsystems 70 may be coupled to opposite sides of the spray body 18A.

The rinse subsystem 70 may include the fluid conduit 25C and openings 72(1)-72(N2). The fluid conduit 25C may be similar to the fluid conduits 25A, 25B regarding communication to the one or more fluid pump (FIG. 1), except that the fluid conduit 25C may include the openings 72(1)-72(N2) to direct secondary fluid 23C towards the polishing pad and away from the inlet port 34. In this manner, the secondary fluid 23C may be directed to the polishing pad 14 to prevent the polishing pad 14 from drying out.

There are other embodiments of the spray system 10. In this regard, FIGS. 5A through 5D are a front-right-top perspective view, a front-left-top perspective view, front sectional view and a bottom view, respectively, of yet another embodiment of a spray system 10B including: a spray body 18B, a group of fluid outlets 22C(1)-22C(N), at least one fluid recess 74(1)-74(N3), and an inlet port 34B. Similar to the spray system 10, the spray body 18B includes a bottom side 19B and a top side 19A, the inner plenum 26, and the inlet port 34B. The group of fluid outlets 22C(1)-22C(N) include an orientation at an angular position theta_D ($\theta_D$) that directs fluid 23 exiting the group of fluid outlets 22C(1)-22C(N) under the bottom side 19B of the spray body 18B and towards the inlet port 34B as shown by arrow 76A. The fluid 23 directed to the polishing pad 14 creates a high energy zone 28B at the working surface 12. Momentum of the fluid 23 provides power to the high energy zone 28B where the fluid 23 interacts with the debris 30 collected earlier at the working surface 12. The fluid 23 dislodges the debris 30 from the working surface 12 at the high energy zone 28B and the debris 30 becomes entrained in the fluid 23 as the fluid 23 moves within the high energy zone 28B and away from the working surface 12 as indicated by arrow 76B. The fluid 23 is directed by the group of fluid outlets 22C(1)-22C(N) with momentum to enter the inlet port 34B. The inlet port 34B may be disposed with an angle theta_c ($\theta_c$) relative to the polishing pad 14 in a range from one-hundred five (105) degrees to one-hundred seventy-five (175) degrees. The angle angle theta_D ($\theta_D$) may be in a range from fifteen (15) degrees to eighty-five (85) degrees relative to a normal of the polishing pad 14. In this manner, the debris 30 may be dislodged and directed away from the polishing pad 14.

Figure 5A:
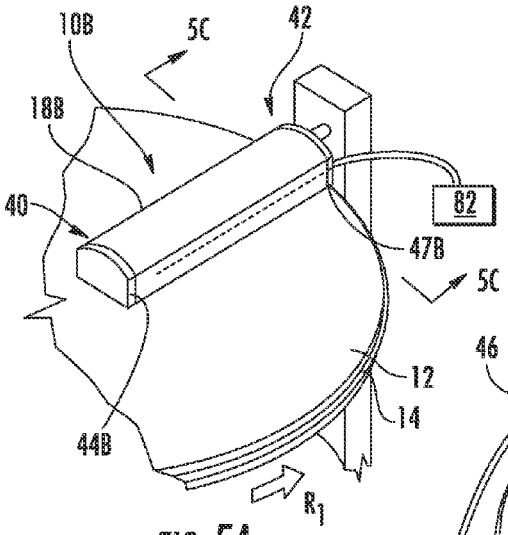
FIGS. 5A through 5D are a front-right-top perspective view, a front-left-top perspective view, front sectional view and a bottom view, respectively, of yet another embodiment of a spray system including a fluid bearing and spiral-shaped inlet port.
Figure 5B:
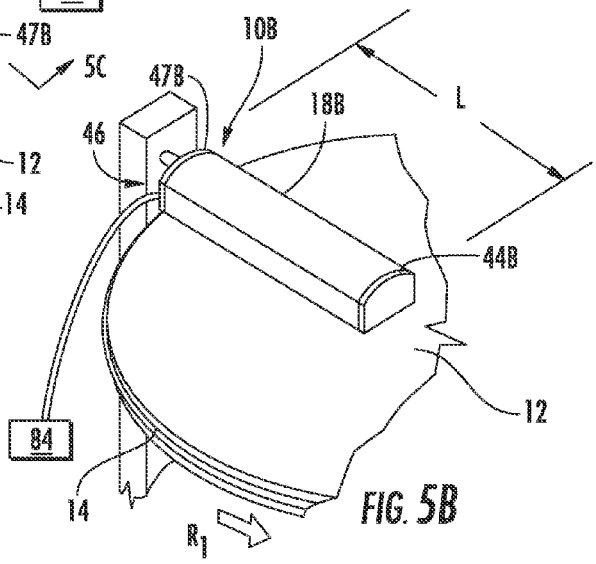
Figure 5C:
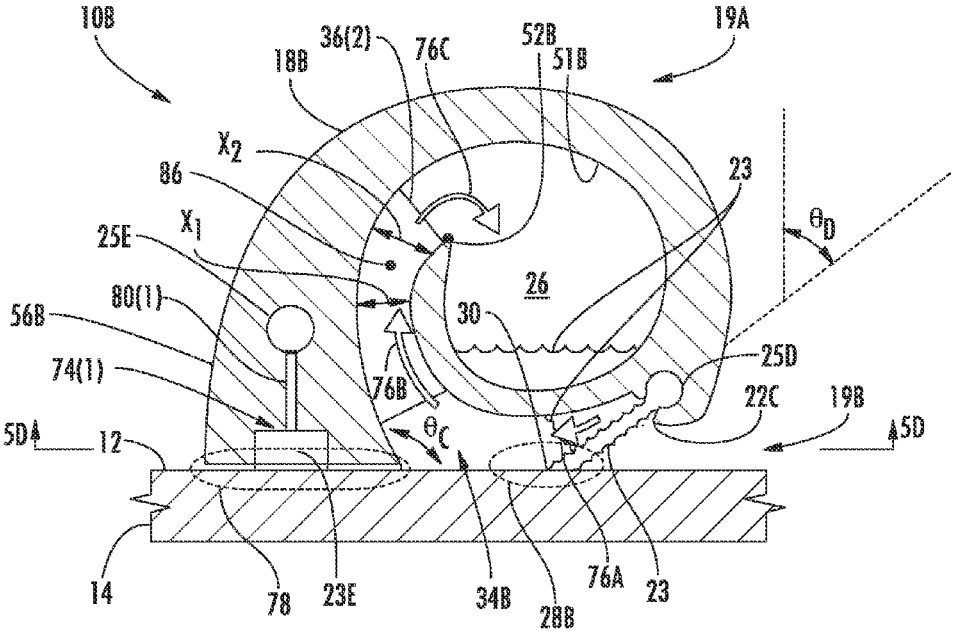
Figure 5D:
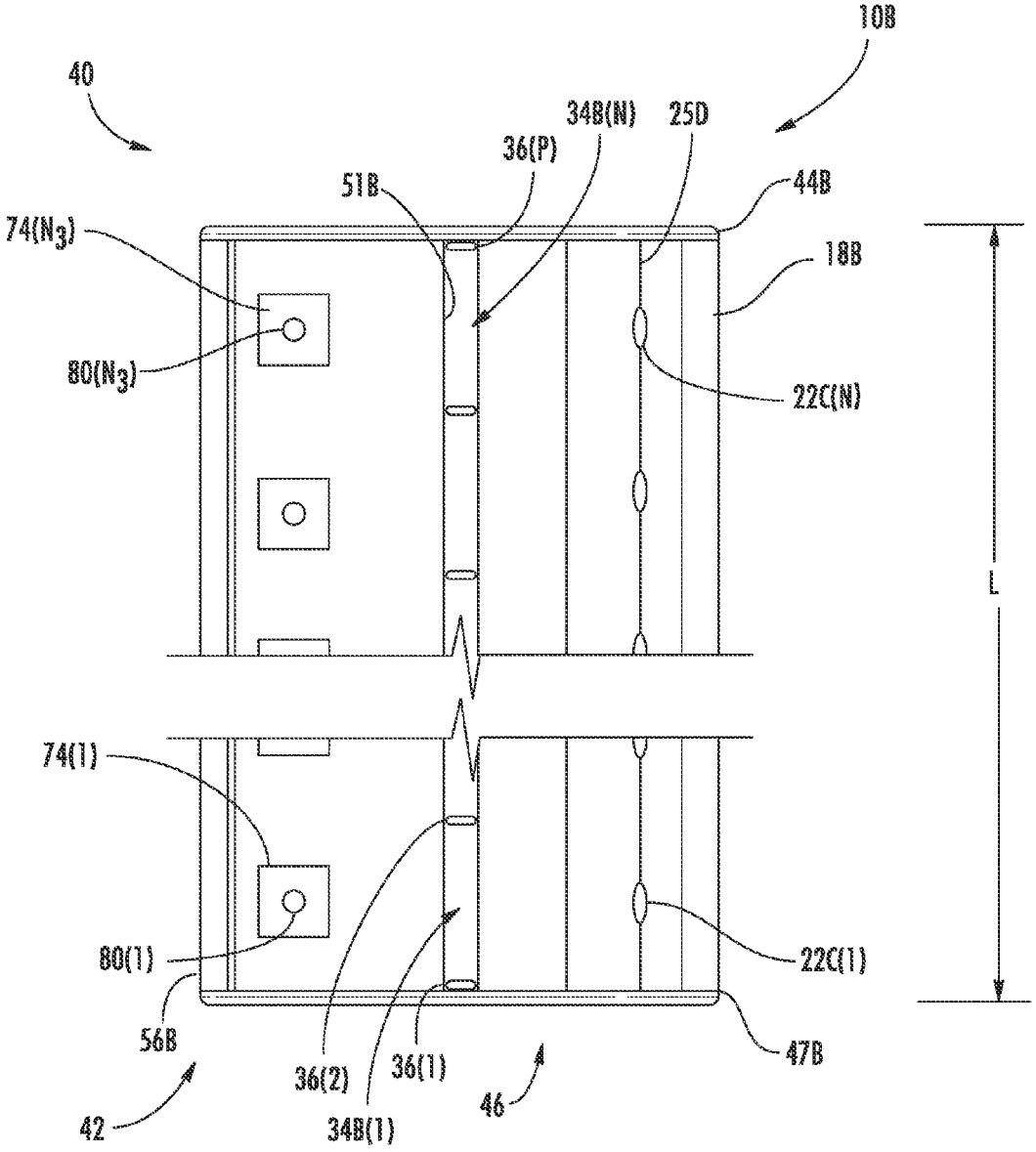

The fluid 23, with the debris 30 entrained, travels through a passageway 86 as part of the inlet port 34B to a lip 52B. The passageway 86 may be a diverging shape to reduce a speed of the fluid 23 as the fluid 23 reaches the lip 52B. The passageway 86 is depicted in FIG. 5C with widths X1 and X2, wherein the downstream width X2 is larger than X1 to provide the diverging shape. The reduced speed may minimize the generation of mist which may carry the debris 30 entrained throughout the manufacturing facility and may scratch later-polished substrates and cause other quality issues. As long as the fluid 23 has sufficient momentum provided by the group of fluid outlets 22C(1)-22C(N), the fluid 23 may cross over the lip 52B to the inner plenum 26 as depicted by arrow 76C (FIG. 5C). The lip 52B and the inner plenum 26 of the spray system of FIG. 5C operate similarly to analogous components of the spray system 10 of FIG. 3A wherein the lip 52B, the inner plenum 26, and the exit port 46 prevent backflow of the fluid 23 to the polishing pad 14. In this regard, the fluid 23 within the inner plenum 26 travels through the exit port 46 (FIG. 5B) to depart the inner plenum 26. In this manner, the debris 30 entrained within the fluid 23 may be removed from the polishing pad 14 and the spray body 18B.

In order to improve the efficiency of the fluid 23 with the debris entrained therein to travel into the inlet port 34B and then to the inner plenum 26, partitions 36(1)-36(P) and a dam 78 may be provided as part of the spray system 10B. The partitions 36(1)-36(P) may be disposed in the inlet port 34B and separate the inlet port 34 into the inlet ports 34B(1)-34B(N) associated respectively with the group of fluid outlets 22C(1)-22C(N) to facilitate the fluid 23 to enter with momentum into the inlet ports 34B(1)-34B(N) of the spray body 18B. Further, the dam 78 extends from the bottom side 19B of the spray body 18B and also connects the inner surface 51B to the exterior surface 56B of the spray body 18B. The dam 78 is formed to be proximate to or abutting against the polishing pad 14 when the spray system 10B operates. The dam 78 prevents or substantially reduces the portion of the fluid 23 which would otherwise escape entry into the inlet port 34B by traveling across the bottom side of the spray body 18B from the inner surface 51B of the spray body 18B to the exterior surface 56B of the spray body 18B. By preventing this escape from the inlet port 34B, the fluid 23 may more efficiently enter the inlet port 34B with the momentum provided by the group of fluid outlets 22C(1)-22C(N). By using the partitions 36(1)-36(P) and the dam 78, the fluid 23 and the debris 30 entrained therein may be efficiently directed to the inner plenum 26 for later removal through the exit port 46.

With continued reference to FIGS. 5A through 5D, the dam 78 may include features to prevent the escape of the fluid 23 from the inlet port 34B. In one case, the spray body 18B may include a fluid conduit 25E, feed channels 80(1)-80(N3), and fluid recesses 74(1)-74(N3). The fluid conduit 25E may be similar in operation to fluid conduits 25A, 25B, except that the fluid conduit 25E is in communication with the feed channels 80(1)-80(N3) which provide the fluid 23E from the fluid conduit 25E to the fluid recesses 74(1)-74(N3). The fluid recesses 74(1)-74(N3) contain the fluid 23E under pressure provided by the fluid conduit 25E which creates a fluid bearing between each of the fluid recesses 74(1)-74(N3) of the spray body 18B and the polishing pad 14. The fluid 23E between the dam 78 of the spray body 18B and the polishing pad 14 also preferentially prevents the fluid 23 with the entrained debris 30 from traveling through the dam 78 of the spray body 18B. In this manner, the dam 78 more effectively directs the fluid 23, with the entrained debris 30, into the inlet port 34B and ultimately into the inner plenum for removal.

Figure 6A:
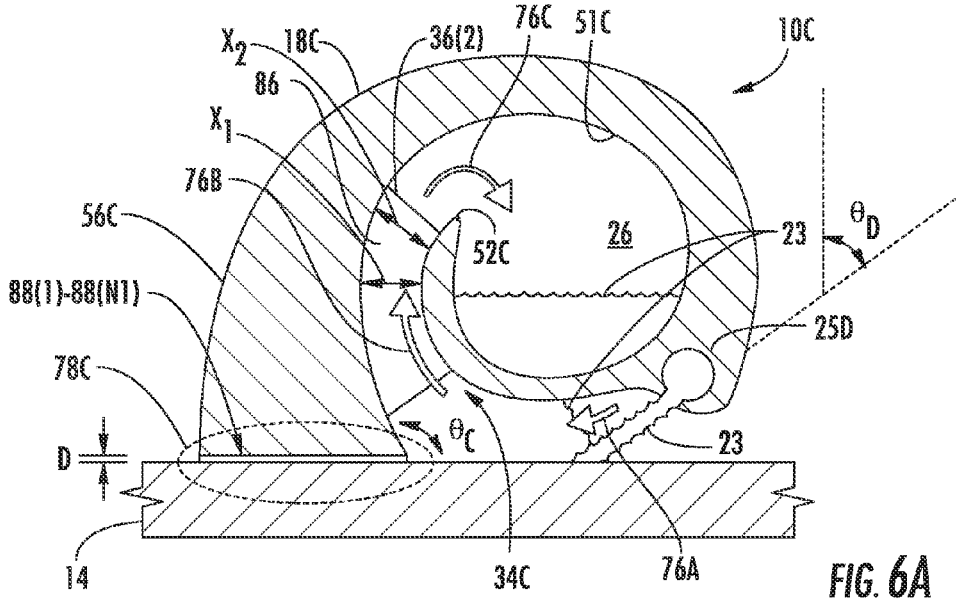
Figures 1, 2, 3, 6B:
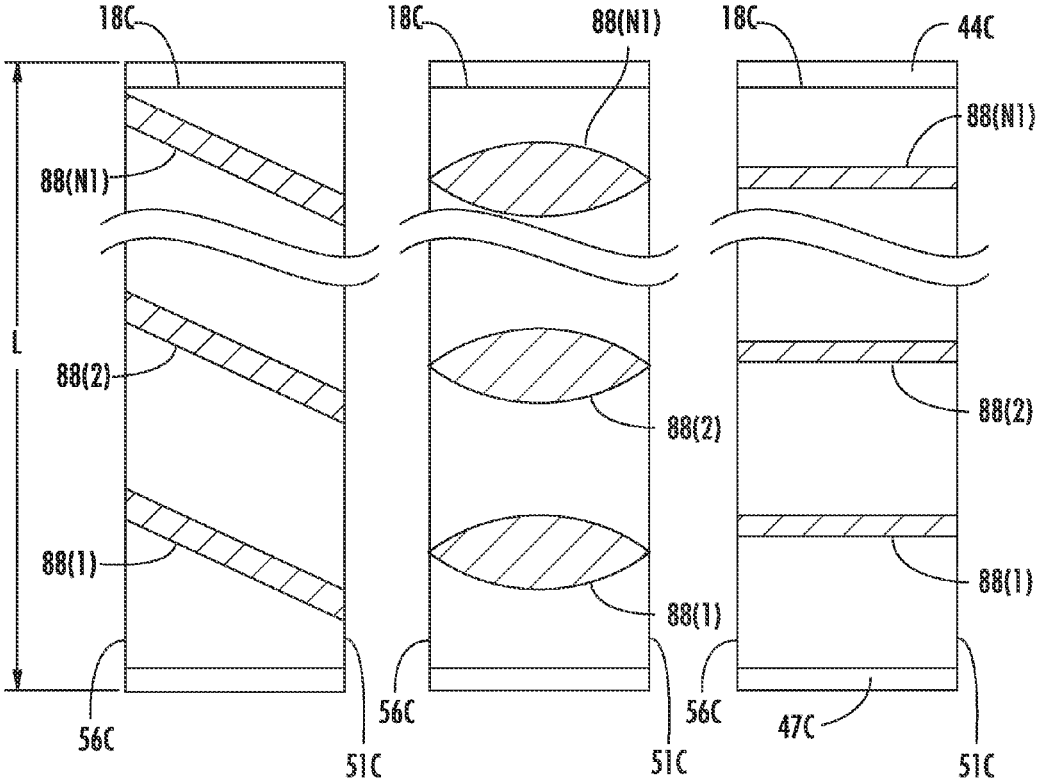

FIGS. 6A and 6B-1 are a front sectional view and a partial bottom sectional view, respectively, of yet another embodiment of a spray system 10C including a spray body 18C, standoffs 88(1)-88(N1), and the inlet port 34C. The spray system 10C is similar to the spray system 10B of FIG. 5C, and so mainly differences will be discussed for clarity and conciseness. In this regard, the spray system 10C may have another embodiment of a dam 78C to facilitate the fluid 23, with the entrained debris 30, to enter the inlet port 34C and travel to the inner plenum 26 for removal from the inlet port 34C. The dam 78C may comprise the standoffs 88(1)-88(N1) to extend a distance D from the spray body 18C. The distance D may be in a range, for example, from a fifth of a millimeter to one (1) millimeter. The standoffs 88(1)-88(N1) also abut against the polishing pad 14 to provide resistance to the movement of the fluid 23, with the entrained debris 30, from traveling between through the dam 78C of the spray body 18C and the polishing pad 14, thereby preferentially directing the fluid 23 into the plenum 26.

The standoffs 88(1)-88(N1) are configured to allow some fluid 23 to pass from the inner surface 51C to the outer surface 56C, thereby maintaining the polishing pad 14 in a wet condition. The standoffs 88(1)-88(N1) may be shaped and/or oriented to prevent dry spots behind the standoffs 88(1)-88(N1) as the fluid 23 exits out from under the dam 78C. For example, the standoffs 88(1)-88(N1) may be in a pattern of protrusions in the form of angled thick lines with respect to a length L of the spray body 18C as shown in FIG. 6B-1. FIGS. 6B-2 through 6B-3 are partial bottom sectional views, respectively, of further embodiments of a spray system 10C with alternative examples of the standoffs 88(1)-88(N1), in patterns of protrusions in the form of teardrops, and straight lines extending from the bottom 19B of the spray body 18C and towards the polishing pad 14.

Figure 7:
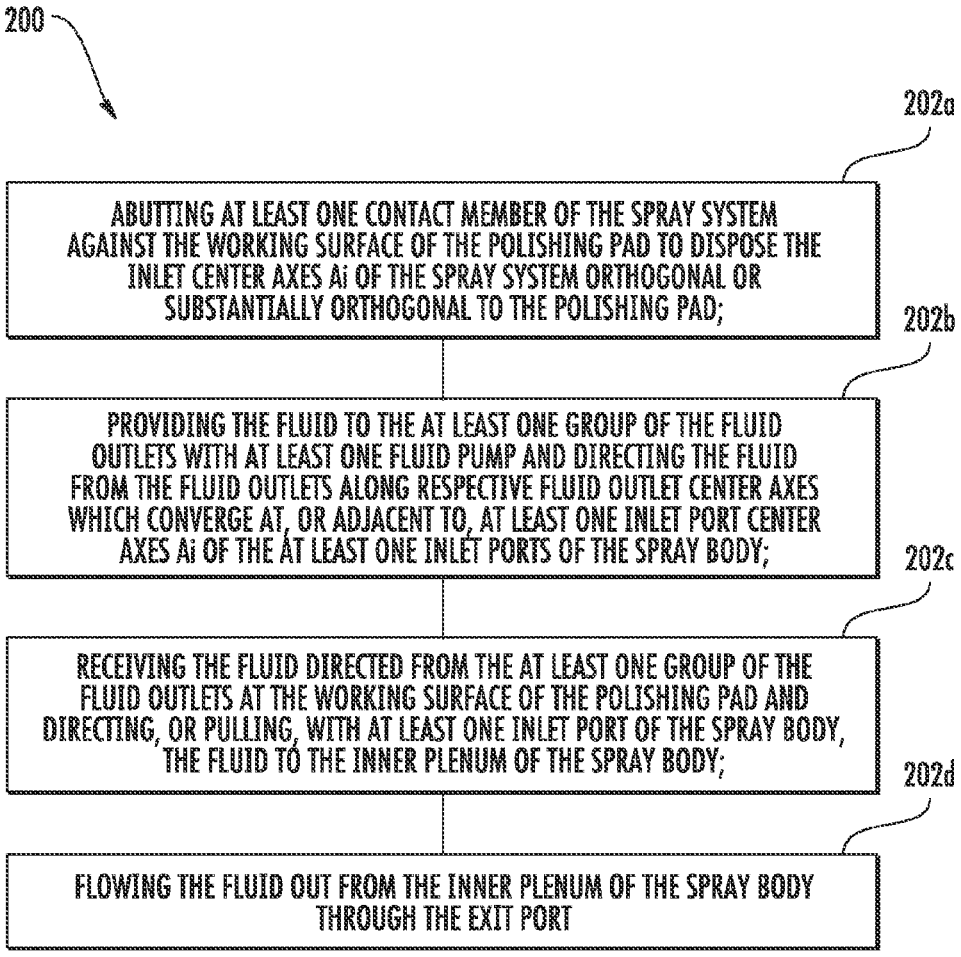
FIG. 7 is a flowchart of an exemplary method to remove debris from the polishing pad.

FIG. 7 is a flow chart of an exemplary method 200 to remove the debris 30 from the polishing pad 14. The method 200 is now discussed using the terminology discussed above in relation to the operations 202*a*-202*d* as represented in FIG. 7. In this regard, the method 200 may include abutting at least one contact member 60, 62 of the spray system 10 against the working surface 12 of the polishing pad 14 to dispose the inlet center axes Ai of the spray system 10 orthogonal or substantially orthogonal to the polishing pad 14 (operation 202*a* of FIG. 7). In this manner, the spray body 18 is readied for cleaning the polishing pad 14.

The method 200 may also include providing the fluid 23 to the at least one group 20(1)-20(N) of the fluid outlets 22A, 22B with at least one fluid pump 82 and directing the fluid 23 from the fluid outlets 22A, 22B (operation 202*b* of FIG. 7). The fluid 23 may be a liquid, for example, de-ionized water. The fluid 23 is directed from the at least one group 20(1)-20(N) of the fluid outlets 22A, 22B along respective fluid outlet center axes AA, AB. The group 20(1)-20(N) of the fluid outlets 22A, 22B are housed and supported by a spray body 18, wherein the respective fluid outlet center axes AA, AB of any one of the at least one group 20(1)-20(N) of fluid outlets 22A, 22B are angled relative to each other and directed to intersect at the convergence point 27 disposed along, or adjacent to, at least one of the inlet port center axes Ai of the at least one inlet port 34(1)-34(N) of the spray body 18. In one embodiment, each of the fluid outlet center axes AA, AB are disposed at an angle ($\theta_A$, $\theta_B$) relative to the respective inlet port center axis Ai, and the angle ($\theta_A$, $\theta_B$) is, for example, in a range from five (5) degrees to eighty-five (85) degrees. The openings 31A, 31B of any two of the fluid outlets 22A, 22B may be separated by the separation distance Ds. In this manner, the fluid 23 may be directed to the polishing pad 14.

The method 200 also includes receiving the fluid 23 directed from the at least one group 20(1)-20(N) of the fluid outlets 22A, 22B at the working surface 12 of the polishing pad 14 and guiding, with at least one inlet port 34(1)-34(N) of the spray body 18, the fluid 23 to the inner plenum 26 of the spray body 18 (operation 202*c* of FIG. 7). Each of the at least one inlet ports 34(1)-34(N) include a respective inlet port center axis Ai disposed orthogonal or substantially orthogonal to the working surface 12 of the polishing pad 14. The at least one inlet ports 34(1)-34(N) may include the at least one diffuser passageway 50(1)-50(N) formed integrally with the spray body 18. The fluid 23 may be directed, or pulled, through the at least one diffuser passageway 50(1)-50(N). The fluid 23 may be guided from the respective throat 48 of the at least one diffuser passageway 50(1)-50(N) to the respective inner lip 52 of the at least one inner surface 51 of the spray body 18. The respective inner lip 52 may be disposed within the inner plenum 26. In this manner, debris 30 entrained in the fluid 23 may be removed from the polishing pad 14 and transferred to the inner plenum 26 where the inner lip 52 prevents backflow of the debris 30 to the polishing pad 14.

The method 200 includes removing the debris 30 from the spray body 18. In particular, the method also includes flowing the fluid 23 with the debris 30 entrained therein out from the inner plenum 26 of the spray body 18 and through the exit port 46 (operation 202*d* of FIG. 7). This fluid 23 may flow to the fluid waste system 84 (FIG. 1) for disposal. In this manner, the debris 30 may be removed from the manufacturing area to prevent contamination.

Figure 8:
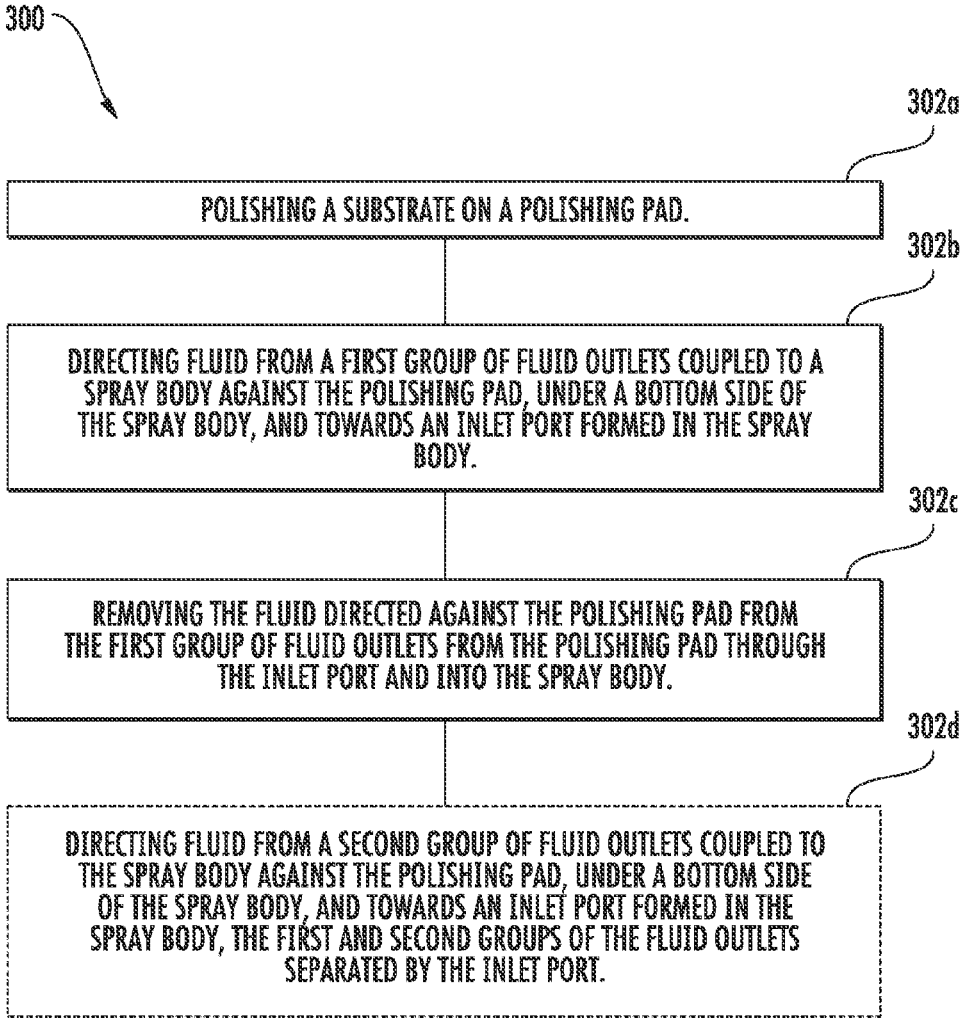
FIG. 8 is a flowchart of an exemplary method for polishing a substrate.

In addition, FIG. 8 is a flow chart of an exemplary method 300 of polishing the substrate 115. The method 300 is now discussed using the terminology discussed above in relation to the operations 302*a*-302*d* as represented in FIG. 8. In this regard, the method 300 may include polishing the substrate 115 on the polishing pad 14 (operation 302*a* of FIG. 8). The method 300 also includes directing the fluid 23 from the first group of fluid outlets 22A(1)-22A(N) coupled to the spray body 18 against the polishing pad 14, under the bottom side 19B of the spray body 18, and towards the inlet port 34 formed in the spray body 18 (operation 302*b* of FIG. 8). The method 300 also includes removing the fluid 23 directed against the polishing pad 14 from the first group of fluid outlets 22A(1)-22A(N) through the inlet port 34 (operation 302*c* of FIG. 8). The method 300 also includes directing the fluid 23 from the second group of fluid outlets 22B(1)-22B(N) coupled to the spray body 18 against the polishing pad 14, under the bottom side 19B of the spray body 18, and towards the inlet port 34 formed in the spray body 18 (operation 302*d* of FIG. 8). The first group of fluid outlets and the second group of fluid outlets may be separated by the inlet port 34. In this manner, the polishing pad 14 may be efficiently cleaned of the debris 30.

Many modifications and other embodiments not set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

While the foregoing is directed to embodiments of the present disclosure, other and further embodiments of the disclosure may be devised without departing from the basic scope thereof, and the scope thereof is determined by the claims that follow.

What is claimed is:

1. A spray system for a polishing pad, comprising:

a spray body having a bottom side and a top side, the spray body including an inlet port open to the bottom side, an inner plenum, and an exit port;

a first group of fluid outlets having an orientation that directs fluid exiting the first group of fluid outlets under the bottom side of the spray body and towards the inlet port; and a partition disposed in the inlet port and separating the inlet port into a first inlet port and a second inlet port, wherein a passageway extends from the inlet port into the inner plenum, the partition preventing mixing of fluid passing through the passageway on opposite sides of the partition.

2. The spray system of claim 1, further comprising:

a second group of fluid outlets having an orientation that directs fluid exiting the second group of fluid outlets under the bottom side of the spray body and towards the inlet port, wherein the inlet port separates the first and second groups of fluid outlets.

3. The spray system of claim 1, wherein the top side of the spray body further comprises a convex exterior top surface.

4. The spray system of claim 1, wherein the passageway extending from the inlet port into the inner plenum to an elevation that allows fluid exiting the passageway to collect in the inner plenum.

5. The spray system of claim 1, wherein the passageway extending from the inlet port into the inner plenum is a diverging passageway.

6. The spray system of claim 1, wherein the partition extends below the bottom side of the body.

7. The spray system of claim 1, wherein the spray body further comprises:

one or more fluid recesses formed in the bottom side of the body, the fluid recesses separated from the first group of fluid outlets by the inlet port.

8. The spray system of claim 1, further comprising:

a third group of fluid outlets coupled to the spray body and having an orientation that directs fluid exiting the third group of fluid outlets away from the inlet port.

9. The spray system of claim 1, further comprising:

a dam coupled to a first end of the body, the dam extending away from the bottom side.

10. The spray system of claim 1, further comprising:

at least one spacer coupled to opposite ends of the body, the spacers extending away from the bottom side, the spacers defining a bearing surface configured to support the spray body on a polishing pad.

11. The spray system of claim 1, wherein at least one of the fluid outlets comprises at least one of a slit, a hole, a replaceable nozzle fitting or a deflector.

12. A chemical mechanical polishing system having a platen for supporting a polishing pad and a polishing head for retaining a substrate while polishing, wherein the improvement comprises:

a spray body having a bottom side facing the platen and a top side, the spray body including an inlet port open to the bottom side, an inner plenum, and an exit port;

a first group of fluid outlets having an orientation that directs fluid exiting the first group of fluid outlets under the bottom side of the spray body and towards the inlet port; and a partition disposed in the inlet port and separating the inlet port into a first inlet port and a second inlet port, wherein a passageway extends from the inlet port into the inner plenum, the partition preventing mixing of fluid passing through the passageway on opposite sides of the partition.

13. The chemical mechanical polishing system of claim 12, further comprising:

a second group of fluid outlets having an orientation that directs fluid exiting the second group of fluid outlets under the bottom side of the spray body and towards the inlet port, wherein the inlet port separates the first and the second groups of fluid outlets.

14. The chemical mechanical polishing system of claim 12, wherein the top side of the spray body further comprises a convex exterior top surface.

15. The spray system of claim 12, wherein the passageway extending from the inlet port into the inner plenum is a diverging passageway.

16. The chemical mechanical polishing system of claim 12, wherein the partition extends below the bottom side of the body.

17. The chemical mechanical polishing system of claim 12, wherein the spray body has one or more fluid recesses formed in the bottom side of the body, the fluid recesses separated from the first group of fluid outlets by the inlet port.

18. The chemical mechanical polishing system of claim 12, further comprising:

a third group of fluid outlets coupled to the spray body and having an orientation that directs fluid exiting the third group of fluid outlets away from the inlet port.

19. The chemical mechanical polishing system of claim 12, further comprising:

a dam coupled to a first end of the body, the dam extending away from the bottom side.

20. The chemical mechanical polishing system of claim 19, further comprising:

at least one spacer coupled to opposite ends of the body, the spacers extending away from the bottom side, the spacers defining a bearing surface configured to support the spray body on a polishing pad.

* * * * *